United States Patent [19]

Packham

[11] Patent Number: 5,005,273

[45] Date of Patent: Apr. 9, 1991

[54] RAG RUG LOOM

[76] Inventor: Jackie F. Packham, 6905 Wisconsin Ave., La Mesa, Calif. 92041

[21] Appl. No.: 392,306

[22] Filed: Aug. 10, 1989

[51] Int. Cl.[5] ..... D03D 29/00

[52] U.S. Cl. ..... 28/149; 139/34

[58] Field of Search ..... 28/149, 150, 151, 152; 139/29, 33, 34; 38/102.7; 289/18.1

[56] References Cited

U.S. PATENT DOCUMENTS

| | | | |
|---|---|---|---|
| 1,233,910 | 7/1917 | Riggs | 38/102.7 |
| 1,313,765 | 8/1919 | Traum | 139/33 |
| 1,941,810 | 1/1934 | Mitchell, Jr. | 38/102.7 |
| 2,202,924 | 6/1940 | Rosen | 289/18.1 X |
| 2,219,268 | 10/1940 | Marcos | 28/149 X |
| 2,263,916 | 11/1941 | Boyle | 28/149 X |
| 2,691,203 | 10/1954 | Wilder | 28/149 |
| 4,072,173 | 2/1978 | Markowitz | 139/34 |
| 4,316,310 | 2/1982 | Packham | 28/149 |

FOREIGN PATENT DOCUMENTS

| | | | |
|---|---|---|---|
| 1019082 | 7/1952 | France | 139/33 |
| 868254 | 5/1961 | United Kingdom | 28/149 |

*Primary Examiner*—Werner H. Schroeder
*Assistant Examiner*—Bradley Kurtz DeSandro
*Attorney, Agent, or Firm*—Andsel Group

[57] ABSTRACT

A rag rug comprising a frame having a pair of laterally spaced longitudinal side members, and a pair of laterally spaced transverse end members that are connected to the respective opposite ends of the longitudinal side members. Two pairs of fold-up legs fastened on the botoms of the transverse end members. A first transverse platen is positioned adjacent one of the transverse end members and a bolt member passes through aligned bores in the respective transverse end member and the bolt member platen and has a cam lock nut with lever. A second transverse platen is positioned adjacent the other transverse end member and it has a pair of bolt members passing through aligned bores in the respective transverse end member and platen and each bolt member has a cam lock nut with lever on its end.

8 Claims, 1 Drawing Sheet

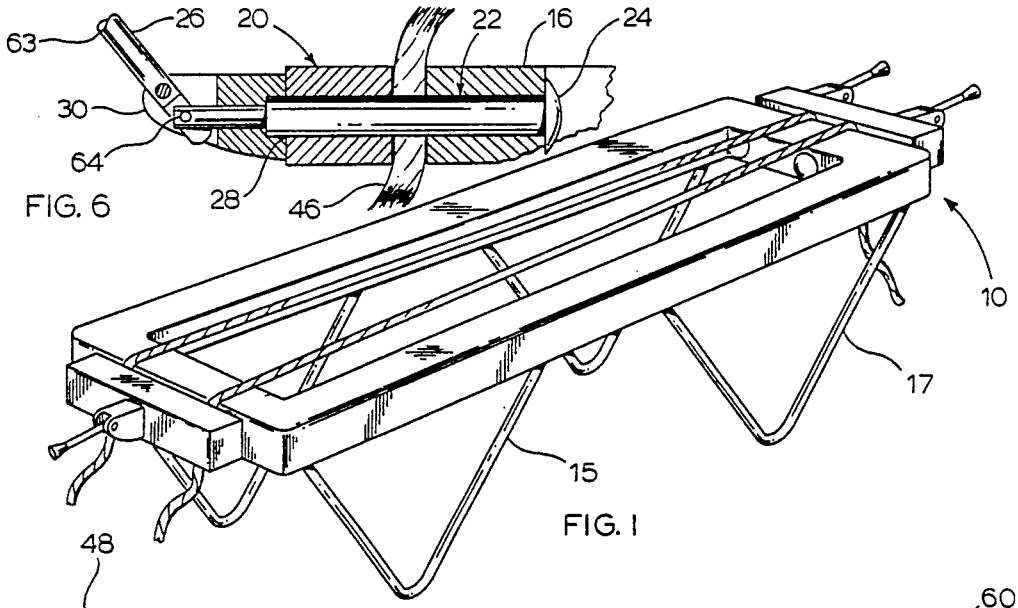
FIG. 6
FIG. 1
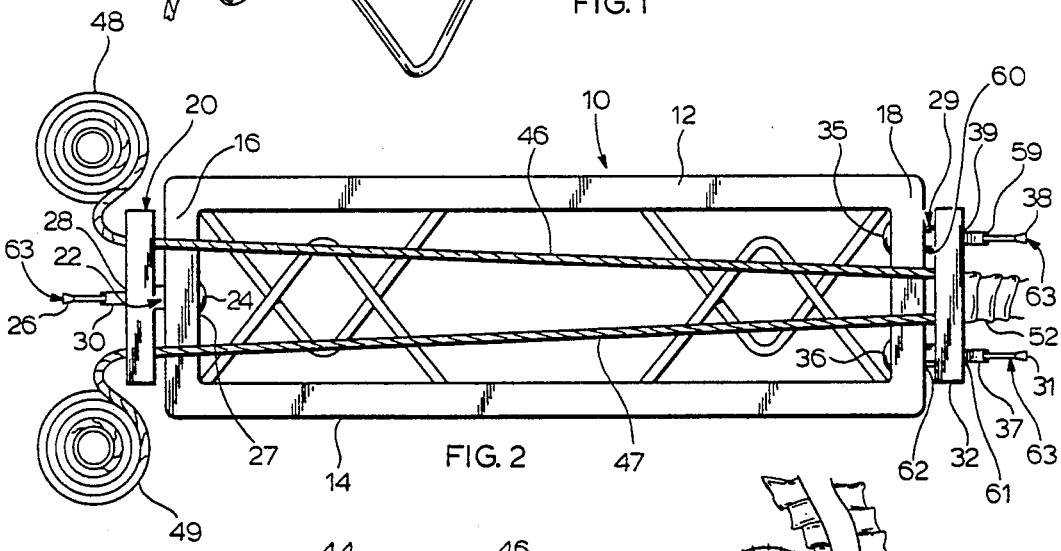
FIG. 2
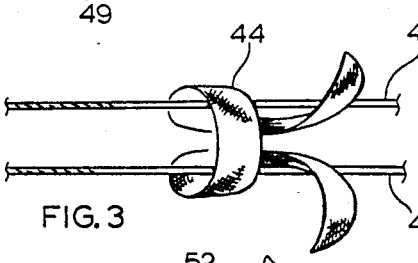
FIG. 3
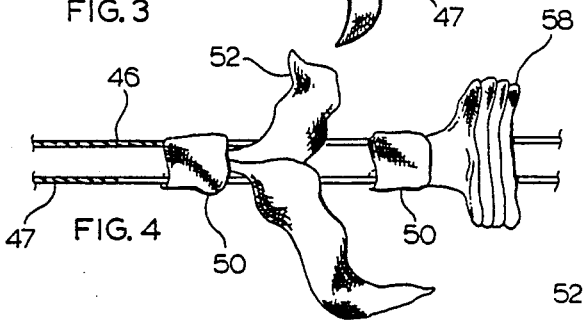
FIG. 4
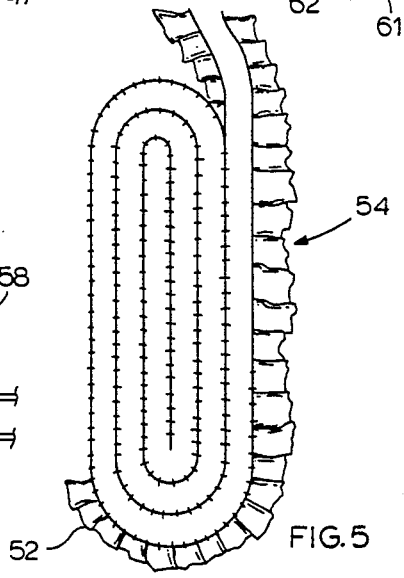
FIG. 5

RAG RUG LOOM

BACKGROUND OF THE INVENTION

This invention relates to a loom and more particularly to a loom used for making strips that are sewn together to form a rag rug.

In the past many different types of carpet weaving frames have been devised. One example of such a frame is illustrated in U.S. Pat. No. 2,219,268. It has a frame having spaced pairs of bars thereon around which strips of material can be wound and then sewn to a pair of strands. The pairs of bars facilitate cutting the strips between the bars of each pair. After this occurs the strands are sewn together to form a carpet or rug with the cut portions of the material extending upwardly from the base formed by the strands.

Another type of a loom is illustrated in U.S. Pat. No. 2,263,916. This loom is also used for making strips for rugs. It has a long and narrow base to which is attached, at one end, an open topped box. The box is large enough to hold two full balls of warp cord. At the other end of the base board is, rigidly mounted, a warp clamp post. Also mounted on the base board and adjacent the open top box is a warp cord tightening device. The string from the open topped box is threaded through the warp cord tightening device and has its end secured in the warp post. Strips of fabric are then looped over the string with the free ends pulled upwardly between the strings and drawn tight as the strip is pulled toward the warp post. After continually adding strips of fabric to the string in the above described manner a strip is formed that can be used to make a rag rug.

U.S. Pat. No. 4,316,310 to Packham on Feb. 23, 1982 discloses a rag rug loom similar to the present invention but does not include the improvements of the quick release cam locks and fold up legs disclosed in the instant invention.

It is an object of the invention to provide a novel rag rug loom that is inexpensive, simple to make and use as well as to provide a loom that is highly efficient in its work.

It is also an object of the invention to provide a novel rag rug loom that can be used to make decorative rugs from scraps of fabric that would otherwise be thrown away.

It is a further object of the invention to provide a novel rag rug loom that can be used by persons undergoing rehabilitation to improve their hand eye skills.

It is an additional object of the invention to provide a novel rag rug loom that can be used by small children in school or in craft programs.

SUMMARY OF THE INVENTION

The rag rug loom of the present invention comprises a frame having a pair of laterally spaced longitudinal side members and a pair of laterally spaced transverse end members that are connected to the respective opposite ends of the longitudinal side members. There are fold-up legs fastened to the bottoms of the transverse members. A first transverse platen is positioned adjacent to one of the transverse end members and the first transverse platen and the transverse end member have aligned bores extending through the respective members. A bolt member passing through the aligned bores has cam lock nut on its end.

A second transverse platen is positioned adjacent the other transverse end member and the second transverse platen and the transverse end member have a pair of aligned bores passing through the respective members. A pair of bolt members passing through the aligned bores have cam lock nut on their ends.

The principal improvements of this invention over the noted prior art is the quick release feature of the bolts attaching the platens to the transverse members together with the fold-up legs.

Prior to using the novel rag rug loom, scrap fabric would be cut into strips one inch wide and about three and a half inches long to provide a good supply of strips. Next the loom would be threaded by tying together the loose ends of two balls of cord and placing the knotted ends between the second transverse platen and its adjacent transverse end member. Next the two cam lock nut levers would be tightened and the two cords of string would be pulled to the opposite end of the loom and run downwardly between the first transverse platen and its adjacent transverse end member. While keeping the cords taut the cam lock nut lever of the single bolt would be tightened.

Now the loom is ready to receive the fabric strips. First a strip of material is placed transversely over both cords and then the two loose ends are folded downwardly over the cords with the loose end pulled up between the two cords. As the loose ends are pulled tight, the strip is also pulled toward the second transverse platen. This step is repeated with additional strips until the length of the loom is filled. At this point all three cam lock nuts are loosened so that the finished strand between the loom transverse end members can be pulled through between the second transverse platen and its respective transverse end member. The two cam lock nuts, adjacent thereto are then tightened and the cords are pulled taut and secured at the other end of the loom by tightening the cam lock passing through the first transverse platen. This operation is repeated until a desired length of rag rug strip is completed. The rug would then be sewn together from the rag rug strip as it is wound in a coiled manner.

A rag rug loom is described that has a frame having a pair of laterally spaced longitudinal side members, and a pair of laterally spaced transverse end members that are connected to the respective opposite ends of the longitudinal side members. A first transverse platen is positioned adjacent one of the pair of laterally spaced transverse end members and has a means for tightening the first transverse platen into rigid surface contact with one of the pair of the laterally spaced transverse end member. There is a second transverse platen positioned adjacent another one of the pair of laterally spaced transverse end members and has a means for tightening the second transverse platen into rigid surface contact with the transverse end member. There is a first and second pair of foldable legs extending downwards from the ends of the transverse end members.

The frame may be formed in one integral plastic material member. The first transverse platen may be positioned adjacent an outer surface of one of the pair of laterally spaced transverse end members. The second transverse platen may be positioned adjacent an outer surface of the other one of the pair of laterally spaced transverse end members. The means for tightening the first transverse platen into rigid surface contact with one of pair of laterally spaced transverse end members comprises at least one bolt member which passes through aligned bores in one of the pair of laterally spaced transverse end members and the first transverse platen and having a cam lock nut pivotally connected on an end of the bolt member, the cam lock nut has a cam lock lever to selectively secure the cam lock nut to the bolt member. The means for tightening the second transverse platen in rigid surface contact with the other one of the pair of laterally spaced transverse end members comprises at least two bolt members which pass through aligned bores in the other one of the pair of laterally spaced transverse end members and the second transverse platen and having a cam lock nut pivotally connected on an end of each of the bolt members.

BRIEF DESCRIPTION OF THE DRAWINGS

FIG. 1 is a perspective view of the novel rag rug loom;

FIG. 2 is a top plan view illustrating how the fabric strips are tied onto the cord;

FIG. 3 is a top plan view illustrating the fabric strips tied in a knot on the cords;

FIG. 4 is a top plan view of the novel rag rug loom; and

FIG. 5 is a top plan view of a rug made from the rag rug strips;

FIG. 6 is an enlarged view of the cam lock nut shown in FIGS. 1 and 2.

DETAILED DESCRIPTION OF THE PREFERRED EMBODIMENTS

The rag rug loom will be described by referring to FIGS. 1-5. The rag rug loom is generally designated numeral 10. It has a pair of laterally spaced longitudinal side members 12 and 14. A pair of laterally spaced transverse end members 16 and 18 are connected to the respective opposite ends of the longitudinal side members 12 and 14. A pair of fold-up legs 15 and 17 are hinged to the bottom ends of the transverse members.

A transverse platen 20 is positioned adjacent transverse end member 16. A bolt 22 having a head 24, and a cam lock nut 63 comprising cam lock 30 and lever 26 passes through aligned bores 27 and 28 in the respective members.

Transverse platen 32 is positioned adjacent transverse end member 18 and it has two bolts 29 and 62 having heads 35 and 36 which pass through aligned bores 39 and 60 and aligned bores 61 and 62 in the respective members with each having a cam lock nut 63 with cam lock 59 and 37, levers 38 and 31 respectively fastened on the end of the cam lock. Once the cords 46, 47 are in the correct position, the end platens 16, 18 are snugged against the cords and the cords against the traverse plates 20, 32, respectively. The cam lock lever 26, 38 (part of 63), which is pivotally connected to the bolt 22 or 29, is moved or cammed from a first position perpendicular to the bolts 22 or 29 and then to a second position in line with the bolts 22 or 29. Camming the lever into the second position pushes the end of the cam lock lever of the cam lock nut 63 against the end platen with an opposite force against the bolt and locks the end platen against the transverse platen. This locks the cords 46 and 47 inbetween the transverse end platens 16 and 18 and the transverse platens 20 and 32, respectively. When it is desired to move the end platen 16 or 18, the lever or levers are cammed to the first position which loosens the platens and the cords. The cord is then able to be moved to a different position in the loom.

The frame of the rag rug loom is preferably made of plastic material however it could be made of one of any number of suitable types of material. When made from plastic it can be formed as an integral member.

In FIGS. 3 and 4, the manner for attaching the strip of fabric 44 to the cord 46 and 47 of balls of string 48 and 49 respectively is illustrated. The strips of material when pulled up tight form a knot 50 and a plurality of these knots 50 when pulled together form a rag rug strip 52. The ultimate product the rage rug 54 is formed by coiling the rag rug strip 52 and stitching the adjacent edges of the strip.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A rag rug loom comprising:

a frame having a pair of laterally spaced longitudinal side members, and a pair of laterally spaced transverse end members that are connected to the respective opposite ends of said longitudinal side members;

a first transverse platen positioned adjacent one of said pair of laterally spaced transverse end members and having means for tightening said first transverse platen into rigid surface contact with said one of said pair of said laterally spaced transverse end members;

a second transverse platen positioned adjacent an other one of said pair of laterally spaced transverse end members and having means for tightening said second transverse platen into rigid surface contact with said other one of said pair of said laterally spaced transverse end member; and a first and second pair of foldable legs extending downwards from the ends of the transverse end members.

2. A rag rug loom as recited in claim 1 wherein said frame made of plastic material.

3. a rag rug loom as recited in claim 2 wherein said frame is formed in one integral member.

4. A rag rug loom as recited in claim 1 wherein said first transverse platen is positioned adjacent an outer surface of one of said pair of laterally spaced transverse end members.

5. A rag rug loom as recited in claim 1 wherein said second transverse platen is positioned adjacent an outer surface of the other one of said pair of laterally spaced transverse end members.

6. A rag rug loom as recited in claim 1 wherein said means for tightening said first transverse platen into rigid surface contact with one of said pair of laterally spaced transverse end members comprises at least one bolt member which passes through aligned bores in said one of said pair of laterally spaced transverse end members and said first transverse platen and having a cam lock nut pivotally connected on an end of the bolt member the cam lock having a cam lock lever to selectively secure the cam lock nut to the bolt member.

7. A rag rug loom as recited in claim 1 wherein said means for tightening said second transverse platen in rigid surface contact with said other one of said pair of laterally spaced transverse end members comprises at least two bolt members which through aligned bores in said other one of said pair of laterally spaced transverse end members and said second transverse platen and having a cam lock nut pivotally connected on an end each of the bolt members, the cam lock nut having a cam lock lever to selectively secure the cam lock nut to the bolt member.

8. A rag rug loom comprising:

a frame having a pair of laterally spaced longitudinal side members, and a pair of laterally spaced transverse end members that are connected to the respective opposite ends of said other longitudinal side members;

said frame is one integral, plastic material member a first transverse platen positioned adjacent one of said pair of laterally spaced transverse end members and having means for tightening said first transverse platen into rigid surface contact with said one of said pair of said laterally spaced transverse end members;

said first transverse platen is positioned adjacent an outer surface of one of said pair of laterally spaced transverse end members;

said means for tightening said first transverse platen into rigid surface contact with one of said pair of laterally spaced transverse end members comprises at least one bolt member which passes through aligned bores in said one of said pair of laterally spaced transverse end members and said first transverse platen and having a cam lock nut pivotally connected on an end of the bolt member the cam lock nut having a cam lock lever to selectively secure the cam lock nut to the bolt member;

a second transverse platen positioned adjacent an other one of said pair of laterally spaced transverse end members and having means for tightening said second transverse platen into rigid surface contact with said other one of said pair of said laterally spaced transverse end members;

said second transverse platen is positioned adjacent an outer surface of the other one of said pair of laterally spaced transverse end members;

said means for tightening said second transverse platen in rigid surface contact with said other one of said pair of laterally spaced transverse end members comprises at least two bolt member which passes through aligned bores in said one of said pair of laterally spaced transverse end members and said first transverse platen and having a cam lock nut pivotally connected on an end of the bolt member; and of each a first and second pair of foldable legs extending downwards from the ends of the transverse end members.

* * * * *